United States Patent [19]

Sasaki et al.

[11] Patent Number: 4,610,732

[45] Date of Patent: Sep. 9, 1986

[54] METHOD OF INHIBITING CORROSION OF ZIRCONIUM OR ITS ALLOY

[75] Inventors: Yuko Sasaki; Katsumi Suzuki; Akira Minato, all of Hitachi; Tomio Yoshida, Takahagi, all of Japan

[73] Assignee: Hitachi, Ltd., Tokyo, Japan

[21] Appl. No.: 714,398

[22] Filed: Mar. 21, 1985

[30] Foreign Application Priority Data

Mar. 23, 1984 [JP] Japan ..... 59-55713

[51] Int. Cl.[4] ..... C23C 25/58

[52] U.S. Cl. ..... 148/6.14 R

[58] Field of Search ..... 148/6.14 R

[56] References Cited

FOREIGN PATENT DOCUMENTS 0039785 3/1983 Japan ..... 148/6.14 R

*Primary Examiner*—Sam Silverberg

*Attorney, Agent, or Firm*—Antonelli, Terry & Wands

[57] ABSTRACT

The invention is to provide zirconium or its alloy used as a material for a chemical device and a nuclear reactor etc. is surface-treated with an oxidizing acid containing an oxidizing metal ion. The oxidizing acid is at least one member or a mixture of two or more selected from the group consisting of, for example, nitric acid ($HNO_3$), hydrogen peroxide ($H_2O_2$), hypochlorous acid (HClO) and potassium permanganate ($K_2MnO_4$) solution, among which nitric acid is most preferred. The oxidizing metal ion is at least one member selected from the group consisting of, for example, ruthenium, rhodium, palladium, osmium, iridium, platinum, chromium, vanadium and cerium ions. Particularly preferred treatment conditions comprise a nitric acid concentration of 14 mol/l (65%) which is close to an azeotropic concentration, a ruthenium ion concentration of at least $1\times10^{-3}$ mol/l and a treatment temperature of a boiling temperature (120° C.). The surface of zirconium or its alloy to be treated may be washed previously with an aqueous acid solution containing hydrofluoric acid. The method of inhibiting corrosion of zirconium or its alloy by surface-treating it with an oxidizing acid containing an oxidizing metal ion can be formed easily a uniform protective film on the surface thereof.

9 Claims, No Drawings

METHOD OF INHIBITING CORROSION OF ZIRCONIUM OR ITS ALLOY

BACKGROUND OF THE INVENTION

This invention relates to a method of inhibiting corrosion of zirconium or its alloy, particularly zirconium or its alloy used as material for a chemical device, a nuclear reactor or the like.

It has been reported that even zirconium or its alloy having excellent corrosion resistance under various circumstances is corroded to cause pitting or the like under severe corroding conditions as chemical processes, since it is affected by a combination of temperature, pressure, pH, reagents and by-products. Under these circumstances, it has eagerly been demanded to further improve the corrosion resistance of metals such as zirconium or its alloy in the field of the chemical industry in which highly corrosive environments are realized.

To improve the corrosion resistance of zirconium or its alloy used as a material for a chemical device, there has been proposed a process wherein it is treated with only nitric acid or with a mixture of nitric acid and another acid. (Japanese Laid-Open Patent No. 39785/83).

The above conventional method of corrosion inhibition have the defects that a protective film cannot be formed easily on the surface of zirconium or its alloy and that no sufficient corrosion resistance can be obtained.

Also the surfaces of nuclear reactor members made of zirconium or its alloy are washed with an acid solution and then autoclaved for use. (Japanese Laid-Open Patent No. 31118/80).

However, in the autoclaving, the product is kept at a temperature of as high as 400° C. under a pressure of as high as 105 kg/cm$^2$ for a long time and many steps are required for the treatment. In addition, when the acid used for the pretreatment remains on the product, the corrosion resistance of the product is deteriorated seriously due to the remaining acid.

SUMMARY OF THE INVENTION

An object of the present invention is to provide a method of inhibiting corrosion of zirconium or its alloy, wherein a protective film can be formed easily on the surface thereof.

An another object of the present invention is to provide a method of inhibiting corrosion of zirconium or its alloy, wherein the corrosion resistance thereof can be obtained sufficiently.

An another object of the present invention is to provide a method of inhibiting corrosion of zirconium or its alloy, wherein the corrosion rate thereof can be become smaller.

The invention is to provide zirconium or its alloy surface-treated with an oxidizing acid containing an oxidizing metal ion.

The oxidizing acid is at least one member or a mixture of two or more selected from the group consisting of, for example, nitric acid ($HNO_3$), hydrogen peroxide ($H_2O_2$), hypochlorous acid (HClO) and potassium permanganate ($K_2MnO_4$) solution, among which nitric acid is most preferred.

The oxidizing metal ion is at least one member selected from the group consisting of, for example, ruthenium, rhodium, palladium, osmium, iridium, platinum, chromium, vanadium and cerium ions.

The ruthenium ion, for example, is obtained from ruthenium compounds such as ruthenium chloride ($RuCl_3.nH_2O$), ruthenium ammonium chloride ($Ru(NH_3)_6Cl_3$), ruthenium nitrate ($Ru(NO_3)_3$) and ruthenium nitrosonitrate ($RuNO(NO_3)_3$). Similarly, rhodium, palladium, osmium, iridium, platinum, chromium, vanadium and cerium ions are obtained from nitrates, chlorides and oxides of rhodium, palladium, osmium, iridium, platinum, chromium, vanadium and cerium, respectively.

The amount of the oxidizing metal ion and the treatment temperature are not particularly limited. They may be selected suitably depending on the oxidizing powers of the acid and metal ion used. For example, when nitric acid containing ruthenium ion as the oxidizing metal ion is used, the concentrations of nitric acid range from 1 mol/l to 14 mol/l and of the ruthenium ion range from $1\times10^{-4}$ mol/l to $1\times10^{-2}$ mol/l, respectively. In other cases, the concentrations of nitric acid range from 8 mol/l to 14 mol/l and the rhodium ion, the palladium ion, the osmium ion, the iridium ion, or the platinum ion is from $1\times10^{-3}$ mol/l to $1\times10^{-2}$ mol/l, respectively; whereas the concentration of nitric acid is from 1 mol/l to 14 mol/l and the concentration of the chromium ion, the vanadium ion and the cerium ion is from $1\times10^{-4}$ mol/l to $1\times10^{-2}$ mol/l, respectively. Any treatment temperature above room temperature may be employed. In general, the preferred treatment temperature is from 80° C. to the boiling temperature of the treatment medium.

Particularly preferred treatment conditions comprise a nitric acid concentration of 14 mol/l (65%) which is close to an azeotropic concentration, a ruthenium ion concentration of at least $1\times10^{-3}$ mol/l and a treatment temperature of a boiling temperature (120° C.).

The surface of zirconium or its alloy to be treated may be washed previously with an aqueous acid solution containing hydrofluoric acid (HF). A preferred acid used for the surface washing is, for example, an aqueous solution of a mixture of hydrofluoric acid and nitric acid (comprising 3 vol % of HF and 40 vol % of $HNO_3$). The washing time of about 3 min will suffice.

The method of inhibiting corrosion of zirconium or its alloy by surface-treating it with an oxidizing acid containing an oxidizing metal ion can easily form a uniform protective film on the surface thereof.

DESCRIPTION OF THE PREFERRED EMBODIMENTS

Commercially available, cold-rolled pure zirconium plates (containing about 1140 ppm of oxygen and 610 ppm of iron as impurities) and tubes made of Zircalloy-2 (comprising 1.46 & of Sn, 0.14% of Fe, 0.11% of Cr and the balance of Zr) having 12 mm outer diameter and 11 mm inner diameter were used. The zirconium plates were cut into pieces having a size of 20 mm×30 mm×2 mm. The tubes made of Zircalloy-2 were cut into a length of 30 mm. The whole surfaces were finished with #1000 emery to obtain samples. The surfaces of the samples were previously washed with an aqueous solution of a mixture of hydrofluoric acid and nitric acid (comprising 3 vol % of HF, 40 vol % of $HNO_3$) for about 3 min.

A flask equipped with a reflux condenser and an external heater to control the temperature of the solution was used. The samples were placed in the flask to be surface-treated under the conditions shown below.

Nitric acid was used as the oxidizing acid. Its concentrations were 14, 8 and 3 mol/l. These solutions were prepared by adding distilled water to commercially available, guaranteed nitric acid having a specific gravity of 1.42 (70%). Each of the ruthenium ion ($Ru^{3+}$; ruthenium chloride $RuCl_3.3H_2O$), rhodium ion ($Rh^{3+}$; rhodium nitrate $Rh(NO_3)_3$), palladium ion [$Pd^{2+}$; palladium nitrate $Pd(NO_3)_2$], osmium ion ($Os^{3+}$; osmic acid $OsO_4$), iridium ion ($Ir^{3+}$; iridium trichloride $IrCl_3$), platinum ion ($Pt^{4+}$; potassium chloroplatinate $K_2PtCl_6$), chromium ion ($Cr^{6+}$; chromium oxide $CrO_3$), vanadium ion ($V^{5+}$; ammonium metavanadate $NH_4VO_3$) and cerium ion [$Ce^{3+}$; cerium nitrate $Ce(NO_3)_3.6H_2O$] was added to each of the nitric acid solutions to realize concentrations of $5\times10^{-3}$ mol/l. The temperature of the solution was controlled a boiling point (120° C. for the 14 mol/l solution). The treatment time was 48 h without intermission in all the cases. (Ex.1~9; Ex.15~23). The period of appropriate treatment usually is 48 hours or more.

Rutheniem ion was added to each of the nitric acid solutions to realize concentrations of $5\times10^{-3}$, $1\times10^{-3}$ and $1\times10^{-4}$ mol/l. The temperature of the solution was controlled to 80° C. or a boiling point (115° C. for the 9 mol/l solution and 104° C. for the 3 mol/l solution). (Ex. 10~14; Ex.24~28).

The corrosion inhibition effects were judged by the following methods (a) and (b).

(a): The surface-treated samples were kept immersed in the boiling (120° C.) 14 mol/l (65%) nitric acid solution for 48 h. The average corrosion rate was calculated from a weight loss thereof. The judgement was effected by comparing the average corrosion rate with an average corrosion rate of the untreated sample determined in the same corrosion test as above.

(b): The untreated samples and surface-treated samples were exposed to a series of high temperature steam atmosphere under a high pressure. Then, changes in weight and surface conditions of the samples were examined. By this method, the sensitivities of the zirconium alloys to the nodular corrosion are determined. This method is employed generally for the examination of corrosion of zirconium alloys used as materials for nuclear reactor members. The samples were exposed to steam at 410° C. under a pressure of 105 kg/cm$^2$ for 8 h and then to steam at 510° C. for 16 h. The corrosion of the samples was examined and the results were compared with those of the untreated samples. The results were judged thus relatively.

Tables 1 and 2 show the surface treatment conditions and corrosion inhibition effects on zirconium plates and tubes made of Zircalloy-2. The corrosion inhibition effects (a) and (b) in the tables refer to the corrosion rate and the surface conditions examined by the above-mentioned test methods (a) and (b) for judging the effects. A symbol 'O' indicates that the corrosion resistance was improved and a symbol '×' indicates that the corrosion resistance was not improved.

It is apparent from the above tables that when the surface of zirconium plates or tubes made of Zircalloy-2 is chemically treated with an oxidizing acid solution such as a solution of nitric acid containing an oxidizing metal ion such as ruthenium or chromium ion, a protective film is formed on the surface of the zirconium plates or tubes made of Zircalloy-2 and the corrosion resistance thereof is improved remarkably.

TABLE 1

| | Surface treatment conditions | | | Anticorrosive effects (a) | | Anticorrosive effects (b) | |
|---|---|---|---|---|---|---|---|
| No. | Added ion | Nitric acid conc. (mol/l) | Temp. (°C.) | Corrosion rate (mm/y) | Evaluation | State of the surface | Evaluation |
| Comp. Ex. | Untreated | — | — | 0.1 | × | white oxide formed | × |
| Ex. 1 | $Ru^{3+}$ $5\times10^{-3}$ mol/l | 14 | 120 | 0.001 | O | excellent | O |
| Ex. 2 | $Rh^{3+}$ $5\times10^{-3}$ mol/l | 14 | 120 | 0.002 | O | " | O |
| Ex. 3 | $Pd^{2+}$ $5\times10^{-3}$ mol/l | 14 | 120 | 0.002 | O | " | O |
| Ex. 4 | $Os^{3+}$ $5\times10^{-3}$ mol/l | 14 | 120 | 0.002 | O | " | O |
| Ex. 5 | $Ir^{3+}$ $5\times10^{-3}$ mol/l | 14 | 120 | 0.003 | O | " | O |
| Ex. 6 | $Pt^{4+}$ $5\times10^{-3}$ mol/l | 14 | 120 | 0.003 | O | " | O |
| Ex. 7 | $Cr^{6+}$ $5\times10^{-3}$ mol/l | 14 | 120 | 0.001 | O | " | O |
| Ex. 8 | $V^{5+}$ $5\times10^{-3}$ mol/l | 14 | 120 | 0.001 | O | " | O |
| Ex. 9 | $Ce^{3+}$ $5\times10^{-3}$ mol/l | 14 | 120 | 0.001 | O | " | O |
| Ex. 10 | $Ru^{3+}$ $1\times10^{-3}$ mol/l | 8 | 115 | 0.005 | O | " | O |
| Ex. 11 | $Ru^{3+}$ $1\times10^{-3}$ mol/l | 8 | 80 | 0.007 | O | " | O |
| Ex. 12 | $Ru^{3+}$ $5\times10^{-3}$ mol/l | 3 | 104 | 0.005 | O | " | O |
| Ex. 13 | $Ru^{3+}$ $5\times10^{-3}$ mol/l | 3 | 80 | 0.008 | O | " | O |
| Ex. 14 | $Ru^{3+}$ $1\times10^{-4}$ mol/l | 14 | 80 | 0.002 | O | " | O |

TABLE 2

| | Surface treatment conditions | | | Anticorrosive effects (a) | | Anticorrosive effects (b) | |
|---|---|---|---|---|---|---|---|
| No. | Added ion | Nitric acid conc. (mol/l) | Temp. (°C.) | Corrosion rate (mm/y) | Evaluation | State of the surface | Evaluation |
| Comp. Ex. | Untreated | — | — | 0.3 | × | white oxide formed | × |
| Ex. 15 | $Ru^{3+}$ $5\times10^{-3}$ mol/l | 14 | 120 | 0.001 | O | excellent | O |

TABLE 2-continued

| | Surface treatment conditions | | | Anticorrosive effects (a) | | Anticorrosive effects (b) | |
|---|---|---|---|---|---|---|---|
| No. | Added ion | Nitric acid conc. (mol/l) | Temp. (°C.) | Corrosion rate (mm/y) | Evaluation | State of the surface | Evaluation |
| Ex. 16 | $Rh^{3+}$ $5 \times 10^{-3}$ mol/l | 14 | 120 | 0.003 | ○ | " | ○ |
| Ex. 17 | $Pd^{2+}$ $5 \times 10^{-3}$ mol/l | 14 | 120 | 0.003 | ○ | " | ○ |
| Ex. 18 | $Os^{3+}$ $5 \times 10^{-3}$ mol/l | 14 | 120 | 0.004 | ○ | " | ○ |
| Ex. 19 | $Ir^{3+}$ $5 \times 10^{-3}$ mol/l | 14 | 120 | 0.005 | ○ | " | ○ |
| Ex. 20 | $Pt^{4+}$ $5 \times 10^{-3}$ mol/l | 14 | 120 | 0.004 | ○ | " | ○ |
| Ex. 21 | $Cr^{6+}$ $5 \times 10^{-3}$ mol/l | 14 | 120 | 0.001 | ○ | " | ○ |
| Ex. 22 | $V^{5+}$ $5 \times 10^{-3}$ mol/l | 14 | 120 | 0.001 | ○ | " | ○ |
| Ex. 23 | $Ce^{3+}$ $5 \times 10^{-3}$ mol/l | 14 | 120 | 0.001 | ○ | " | ○ |
| Ex. 24 | $Ru^{3+}$ $1 \times 10^{-3}$ mol/l | 8 | 115 | 0.003 | ○ | " | ○ |
| Ex. 25 | $Ru^{3+}$ $1 \times 10^{-3}$ mol/l | 8 | 80 | 0.005 | ○ | " | ○ |
| Ex. 26 | $Ru^{3+}$ $5 \times 10^{-3}$ mol/l | 3 | 104 | 0.003 | ○ | " | ○ |
| Ex. 27 | $Ru^{3+}$ $5 \times 10^{-3}$ mol/l | 3 | 80 | 0.006 | ○ | " | ○ |
| Ex. 28 | $Ru^{3+}$ $1 \times 10^{-4}$ mol/l | 14 | 80 | 0.004 | ○ | " | ○ |

It will be appreciated from the foregoing examples that the method of the present invention is suitable for zirconium (pure) and alloys thereof including Zircalloy-4, Zircalloy-3, and Zr-2.5% Nb alloy.

What is claimed is:

1. A method of inhibiting corrosion of zirconium or its alloy, wherein zirconium or its alloy is surface-treated with a nitric acid containing a ruthenium ion.

2. A method of inhibiting corrosion of zirconium or its alloy as defined in claim 1, wherein concentrations of said nitric acid and said ruthenium ion are, respectively, close to an azeotropic concentration and at least $1 \times 10^{-3}$ mol/l, and a treatment temperature is controlled a boiling point of a nitric acid solution.

3. A method of inhibiting corrosion of zirconium or its alloy as defined in claim 1, wherein said ruthenium ion is obtained from a ruthenium chloride.

4. A method of inhibiting corrosion of zirconium or its alloy as defined in claim 1, wherein said surface treatment is effected in a boiling nitric acid containing a ruthenium ion.

5. A method of inhibiting corrosion of zirconium or its alloy as defined in claim 1, wherein said zirconium or its alloy to be surface-treated is pretreated with an acid containing hydrofluoric acid.

6. A method of inhibiting corrosion of zirconium or its alloy, wherein said zirconium or its alloy is surface-treated with a nitric acid containing at least one ion of an oxidizing metal selected from the group consisting of vanadium, chromium, ruthenium, rhodium, palladium, osmium, iridium, platinum and cerium.

7. A method of inhibiting corrosion of zirconium or its alloy as defined in claim 6, wherein said at least one ion of an oxidizing metal selected from the group consisting of vanadium, chromium, ruthenium, rhodium, palladium, osmium, iridium, platinum and cerium is obtained from at least one compound selected from the group consisting of an ammonium metavanadate, a chronium oxide, a ruthenium chloride, a rhodium nitrate, a palladium nitrate, an osmic acid, an iridium trichloride, a potassium chloroplatinate, and a cerium nitrate.

8. A method of inhibiting corrosion of zirconium or its alloy as defined in claim 6, wherein said surface treatment is effected in a boiling nitric acid containing at least one ion of said oxidizing metal.

9. A method of inhibiting corrosion of zirconium or its alloy as defined in claim 6, wherein said zirconium or its alloy to be surface-treated is pretreated with an acid containing hydrofluoric acid.

* * * * *